US011806731B2

(12) United States Patent
Banerjee et al.

(10) Patent No.: US 11,806,731 B2
(45) Date of Patent: Nov. 7, 2023

(54) CYCLONIC SEPARATOR

(71) Applicant: Weir Minerals Africa (Pty) Limited, Gauteng (ZA)

(72) Inventors: Chandranath Banerjee, West Bengal (IN); Eduardo Cepeda, Santiago (CL); Niyam Balacharya Joshi, Bangalore (IN); Amith Thirumale Muralidhara, Bangalore (IN)

(73) Assignee: Weir Minerals Africa (Pty) Limited

( * ) Notice: Subject to any disclaimer, the term of this patent is extended or adjusted under 35 U.S.C. 154(b) by 124 days.

(21) Appl. No.: 17/634,503

(22) PCT Filed: Aug. 18, 2020

(86) PCT No.: PCT/IB2020/057759

§ 371 (c)(1),
(2) Date: Feb. 10, 2022

(87) PCT Pub. No.: WO2021/038379

PCT Pub. Date: Mar. 4, 2021

(65) Prior Publication Data

US 2022/0288607 A1 Sep. 15, 2022

(30) Foreign Application Priority Data

Aug. 29, 2019 (GB) ..... 1912400

(51) Int. Cl.
*B04C 5/28* (2006.01)
*B04C 5/04* (2006.01)
(Continued)

(52) U.S. Cl.
CPC ..... *B04C 5/28* (2013.01); *B04C 5/04* (2013.01); *B04C 5/103* (2013.01); *B04C 2005/133* (2013.01)

(58) Field of Classification Search
CPC .... B04C 5/28; B04C 5/26; B04C 5/24; B04C 5/04; B04C 5/103; B04C 2005/133
See application file for complete search history.

(56) References Cited

U.S. PATENT DOCUMENTS 2,756,878 A * 7/1956 Herkenhoff ..... B04C 5/13 209/732
4,090,956 A 5/1978 Benzon
(Continued)

FOREIGN PATENT DOCUMENTS

CN 1301195 A 6/2001
DE 10038282 A1 2/2002
(Continued)

*Primary Examiner* — Michael McCullough
*Assistant Examiner* — Jessica L Burkman
(74) *Attorney, Agent, or Firm* — Morriss O'Bryant Compagni Cannon, PLLC.

(57) ABSTRACT

A cyclonic separator (10) comprises a separation chamber (14), a feed inlet (16) leading into the separation chamber and an underflow discharge (18) leading from the separation chamber. The cyclonic separator further comprises a vortex finder which has an inlet end positioned in the separation chamber, an outlet end defining an overflow discharge, and a bleed opening (48) defined by the inlet and outlet ends of the vortex finder and through which a portion of an overflow stream can be bled from the vortex finder to remove oversized particles from the overflow stream.

11 Claims, 4 Drawing Sheets

(51) Int. Cl.
*B04C 5/103* (2006.01)
*B04C 5/13* (2006.01)

(56) References Cited

U.S. PATENT DOCUMENTS

| | | | | | |
|---|---|---|---|---|---|
| 4,226,708 | A * | 10/1980 | McCartney | B04C 5/13 | 209/733 |
| 4,406,781 | A * | 9/1983 | Nightingale | C10L 9/00 | 209/729 |
| 4,622,150 | A | 11/1986 | Carroll | | |
| 4,670,161 | A * | 6/1987 | Hayatdavoudi | B04C 11/00 | 209/733 |
| 6,461,499 | B1 | 10/2002 | Bosman | | |
| 2010/0258512 | A1 | 10/2010 | Larson | | |
| 2012/0097616 | A1* | 4/2012 | Backman | B03D 1/02 | 210/194 |
| 2014/0225286 | A1* | 8/2014 | Paxton | B01D 17/0217 | 261/79.2 |
| 2016/0207070 | A1* | 7/2016 | Goosen | B02C 23/12 | |

FOREIGN PATENT DOCUMENTS

| | | | |
|---|---|---|---|
| EP | 2448680 | A1 | 5/2012 |
| GB | 886921 | A | 1/1962 |
| GB | 1053159 | A | 12/1966 |
| KR | 20120088044 | A | 8/2012 |
| SE | 464278 | B | 4/1991 |
| WO | 2017118459 | A1 | 7/2017 |

* cited by examiner

CYCLONIC SEPARATOR

This invention relates to separation apparatus. More particularly, it relates to a method of operating a cyclonic separator and to a cyclonic separator.

Cyclonic separators of which the Inventors are aware typically comprise a hollow body which defines a separation chamber and which includes an upper section which is generally cylindrical and a lower section which protrudes from and tapers away from a lower end of the upper section. A feed inlet leads into the upper section towards the top thereof to feed fluid into the upper section generally tangentially to cause swirling flow. A discharge outlet or underflow discharge opening, leads from the lower end of a frusto-conical portion, i.e. the end remote from the upper section. A tubular member, usually referred to as a vortex finder extends through an upper end of the upper section and has an inlet end which is positioned in the cavity defined by the body and an outlet end which forms an outlet or overflow.

In use, fluid is fed into the body through the feed inlet such that a vortex or swirling flow is created within the body. The spiralling fluid initially moves downwardly in the form of an outer vortex and then at least a portion of the spiralling fluid, referred to herein as an overflow stream, moves upwardly in the form of an inner vortex (or air core) through the centre of the separator and out through the vortex finder as overflow. By virtue of the configuration of the body the fluid and the particles entrained therein are subjected inter alia to centripetal and gravitational forces. This causes a separation of the particles based on particle size, weight and/or specific gravity, such that larger, heavier more dense particles move radially outwardly in the outer vortex and are discharged through the underflow discharge opening and smaller, lighter, less dense particles remain entrained in the portion of the fluid forming the inner vortex or overflow stream which passes through the vortex finder and out through the overflow discharge.

This arrangement provides a cost-effective manner of separating the particles into two groups, i.e. a coarse fraction containing larger, heavier and/or more dense particles which are discharged from the underflow discharge opening defined by a spigot and a fine fraction or overflow stream containing smaller, lighter and less dense particles which are discharged from the vortex finder through the overflow.

One problem with cyclone separators of which the Inventors are aware is that particles which are larger than a maximum desired size are sometimes entrained in the overflow stream passing through the vortex finder. These larger particles may potentially cause damage to equipment downstream of the overflow which may necessitate further processing equipment to remove them which naturally leads to an increase in cost and potentially a decrease in efficiency. Cyclone separators that are used in separating fine particles in a slurry from the heavier particles in the slurry are referred to as hydrocyclones. It is also relatively time consuming to change the proportion of particles that are delivered to the overflow relative to the underflow. Depending on the application of the hydrocyclone, a different relative proportion may be desirable.

It is an object of embodiments of this invention to provide means which the Inventors believe will at least ameliorate this problem or other problems in the prior art, or provide a useful alternative.

According to a first aspect, there is provided a cyclonic separator comprising: a separation chamber, a feed inlet leading into the separation chamber, an underflow discharge leading from the separation chamber, and a vortex finder, the vortex finder comprising an axially arranged upstream portion positioned in the separation chamber, an axially arranged downstream portion defining an overflow discharge, and a bleed opening defined between the upstream and downstream portions and through which a portion of an overflow stream can be bled from the vortex finder to remove oversized particles from the overflow stream, wherein the upstream and downstream portions of the vortex finder are co-axial and at least one of the portions is axially displaceable relative to the other to permit the spacing between adjacent ends of the upstream and downstream portions of the vortex finder, and hence the size of the bleed opening, to be adjustable.

In the context of the specification, the term "oversized particles" is to be understood to include particles which are larger, heavier and/or have a higher specific gravity than the desired maximum size of particles contained in the fine fraction or overflow stream.

The separator may include a body having a top and a sidewall which together define the separation chamber. The sidewall may have a generally cylindrical upper portion, and a frusto-conical lower portion which tapers away from the upper portion, the underflow discharge being defined by a spigot attached to the lower end of the lower portion of the sidewall.

The feed inlet may be configured to feed fluid into the separation chamber at or close to the top thereof generally tangentially to create a swirling flow of the fluid in the separation chamber.

The upstream portion of the vortex finder may include an upstream end which is positioned in the separation chamber and forms the inlet end and a downstream end, the downstream portion of the vortex finder having an upstream end and a downstream end which forms the overflow discharge, the bleed opening being defined between the downstream end of the upstream portion of the vortex finder and the upstream end of the downstream portion of the vortex finder.

The upstream and downstream portions of the vortex finder may be of the same diameter.

The upstream and downstream portions of the vortex finder may have a cylindrical or non-cylindrical shape. The non-cylindrical shape may comprise a polygon in cross section, an ellipse, or any other convenient shape.

The upstream and downstream portions of the vortex finder may have different diameters to each other (where cylindrical) or different cross-sectional areas.

The upstream and/or downstream portions may not have a uniform cross-section along its or their length, for example, one or both of the portions may comprise converging or diverging shapes, or any other convenient shape or profile.

In one embodiment, both (rather than just one of) the upstream and downstream portions of the vortex finder may be axially displaceable relative to one another to permit the spacing between adjacent ends of the upstream and downstream portions of the vortex finder and hence the size of the bleed opening to be adjustable. The upstream and downstream portions of the vortex finder may be displaceable between a closed position in which the bleed opening is closed and a fully open position in which the bleed opening is at its maximum size.

The bleed opening may lead into an intermediate chamber from which a secondary overflow leads. The intermediate chamber may be annular.

The intermediate chamber may be defined by a circular top and a sidewall depending from the top. The sidewall may include a cylindrical upper portion which depends from the top and a frusto-conical lower portion which protrudes from the lower end of the upper portion of the sidewall such that it tapers away from the top. A free or lower end of the frusto-conical portion may be connected to the downstream end of the upstream portion of the vortex finder.

According to a second aspect, there is provided a method of operating a cyclonic separator which includes a separation chamber, a feed inlet leading into the separation chamber, an underflow discharge leading from the separation chamber and a vortex finder which has an inlet end positioned in the separation chamber and an outlet end defining an overflow discharge, the inlet and outlet end defining a bleed opening therebetween, which method includes bleeding a portion of an overflow stream passing through the vortex finder from the vortex finder at a position between the inlet and outlet ends of the vortex finder to remove oversized particles from the overflow stream, and adjusting the size of the bleed opening.

The method may include feeding the portion of the overflow stream which is bled from the vortex finder into an intermediate chamber from which an intermediate discharge opening leads.

Adjusting the size of the bleed opening allows the volume and/or flow rate of fluid bled form the overflow stream to be adjusted.

According to a third aspect, there is provided a vortex finder comprising (i) an inlet end for locating in a separation chamber of a cyclone, (ii) an outlet end defining an overflow discharge, and (iii) a bleed opening leading from the vortex finder at a position between the inlet and outlet ends of the vortex finder through which a portion of an overflow stream can be bled from the vortex finder to remove oversized particles from the overflow stream, wherein at least one of the inlet and outlet ends of the vortex finder is axially displaceable relative to the other to permit the spacing between adjacent ends of the inlet and outlet ends of the vortex finder, and hence the size of the bleed opening, to be adjustable.

The upstream portion of the vortex finder may include an upstream end which is positioned in the separation chamber and forms the inlet end and a downstream end, the downstream portion of the vortex finder having an upstream end and a downstream end which forms the overflow discharge, the bleed opening being defined between the downstream end of the upstream portion of the vortex finder and the upstream end of the downstream portion of the vortex finder.

According to a fourth aspect, there is provided an automatic cyclone control system comprising the cyclonic separator of the first aspect; at least one sensor operable to measure a characteristic of an underflow or overflow discharge of the cyclonic separator; an actuator operable to control opening and closing of a bleed opening in a vortex finder of the cyclonic separator; and a controller operable to control the actuator in response to a measurement recorded by the at least one sensor.

The at least one sensor may comprise an accelerometer, an ultrasonic sensor or any other convenient sensor.

The actuator may comprise an electric, pneumatic, mechanical or hydraulic drive, such as a solenoid. The actuator may be a mechanical device operated manually or by a motor.

According to a fifth aspect, there is provided a vortex finder comprising (i) an inlet portion for locating in a separation chamber of a cyclone, (ii) an outlet portion in fluid communication with the inlet portion and defining an overflow discharge, and (iii) an intermediate chamber defining a secondary overflow, wherein at least one of the inlet and outlet portions of the vortex finder is axially displaceable relative to the other to permit the spacing between adjacent ends of the inlet and outlet portions of the vortex finder, and hence the size of the bleed opening, to be adjusted.

The inlet portion may be referred to as an upstream portion, similarly, the outlet portion may be referred to as a downstream portion; in each case, with reference to flow out of the cyclone.

The secondary overflow may be oriented transverse to the overflow discharge. The secondary overflow may be oriented generally perpendicular to the overflow discharge.

The intermediate chamber may define a bleed opening near the inlet portion or outlet portion, so that some of an overflow stream entering the vortex finder can be bled from the vortex finder to remove oversized particles from the overflow stream.

The bleed opening may be defined by a gap between the inlet portion and the outlet portion. Alternatively, the bleed opening may be defined by one or more apertures defined by the inlet portion and outlet portion, such that one of the inlet portion or the outlet portion may be rotated relative to the other, and apertures in one of the portions are opened (when the apertures in the two portions align) or closed (when the apertures in the two portions do not align) by the other.

According to a sixth aspect there is provided a cyclonic separator comprising: (i) a separation chamber, (ii) a feed inlet leading into the separation chamber, (iii) an underflow discharge leading from the separation chamber, and (iv) a vortex finder, the vortex finder comprising (a) an inlet end positioned in the separation chamber, (b) an outlet end defining an overflow discharge, and (c) a bleed opening defined by the inlet and outlet ends of the vortex finder and through which a portion of an overflow stream can be bled from the vortex finder to remove oversized particles from the overflow stream, wherein the inlet and/or outlet ends of the vortex finder are adjustable to increase the area of the bleed opening.

The inlet and outlet ends of the vortex finder may be adjustable in height (axial displacement).

Alternatively, or additionally, the inlet and outlet ends of the vortex finder may be adjustable in width, for example, an inlet end proximal the outlet end (and/or an outlet end proximal the inlet end) may be enlarged or constricted to increase or reduce the area of the bleed opening.

Alternatively, or additionally, the inlet and outlet ends of the vortex finder may be co-axial, part of one end being located inside part of the other end, and both ends defining apertures or cut-away portions, whereby rotation of one of the ends may align the apertures or cut-away portions to increase the area of the bleed opening.

According to a seventh aspect, there is provided a method of operating a cyclonic separator having a vortex finder creating two overflow outputs, the method comprising (i) directing a first overflow output from the vortex finder to a first location, and (ii) directing a second overflow output from the same vortex finder separator to a second location.

By virtue of this aspect, two different overflow outputs are provided that can have different particle size distributions, and each output can be directed to the most appropriate location based on its particle size distribution.

The method may comprise the further step of bleeding a portion of an overflow stream passing through the vortex finder at a position between inlet and outlet ends of the vortex finder to create the second overflow output.

The second overflow output may include larger particles from the overflow stream, and the first overflow output may include smaller particles from the overflow stream.

The second overflow output may be directed to an ore grinding stage for further grinding. Alternatively, the second overflow output may be directed to a concentrator or thickener.

These and other aspects will now be described, by way of example, with reference to the accompanying diagrammatic drawings, in which.

DETAILED DESCRIPTION OF AN EXAMPLE EMBODIMENT

Figure 1:
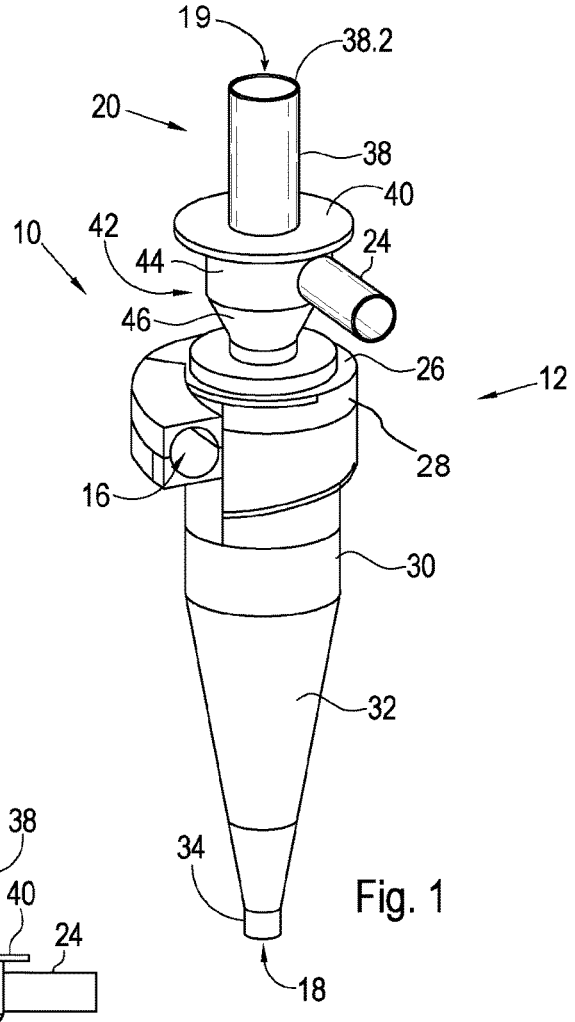
FIG. 1 is a three-dimensional view of a cyclonic separator in accordance with one embodiment of the invention.
Figure 2:
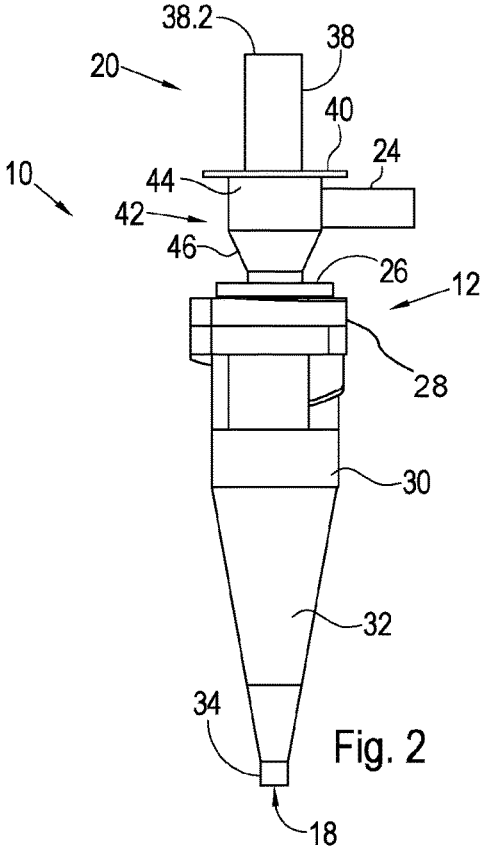
FIG. 2 is a side view of the cyclonic separator of FIG. 1.
Figure 3:
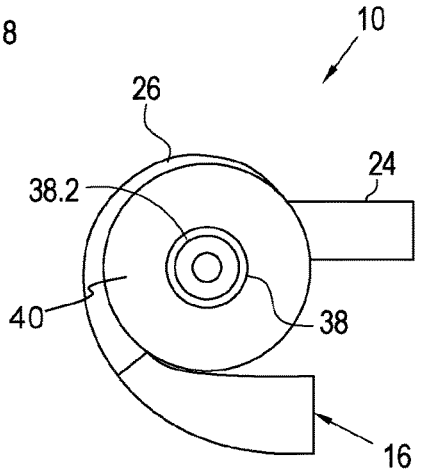
FIG. 3 is a top view of the cyclonic separator of FIG. 1.

The following description of an embodiment of the invention is provided as an enabling teaching. Those skilled in the relevant art will recognise that many changes can be made to the embodiments described, while still attaining the beneficial results of the present invention. It will also be apparent that some of the desired benefits of the present invention can be attained by selecting some of the features of the disclosed embodiments without utilising other features. Accordingly, those skilled in the art will recognise that modifications and adaptations to these embodiments are possible and can even be desirable in certain circumstances. Thus, the following description is provided as illustrative of the principles of the present invention and not a limitation thereof.

In the drawings, reference numeral 10 refers generally to a cyclonic separator in accordance with an embodiment of the invention. In this embodiment, the separator 10 is a hydrocyclone. The separator 10 includes a body 12 which, as described in more detail below, defines a separation chamber 14 (FIGS. 4 to 6), a feed inlet 16, an underflow discharge 18, an overflow discharge 19, and a vortex finder 20. The vortex finder 20 comprises an intermediate chamber 22 (FIGS. 4 to 6) and a secondary overflow 24.

The separation chamber 14 is defined by a circular top 26 from which a sidewall 28 depends. The sidewall 28 has a cylindrical upper portion 30, an upper end of which is closed by the top 26, and a frusto-conical lower portion 32 which is attached to and protrudes from the edge of the upper portion 30 remote from the top 26. The lower portion 32 tapers inwardly away from the upper portion 30 and terminates in a spigot 34 which defines the underflow discharge 18.

The feed inlet 16 is configured to feed fluid (such as slurry) into the separation chamber 14 through the upper portion 30 of the sidewall 28 generally tangentially thereto such that a swirling flow of fluid is created in the separation chamber 14.

Figure 4:
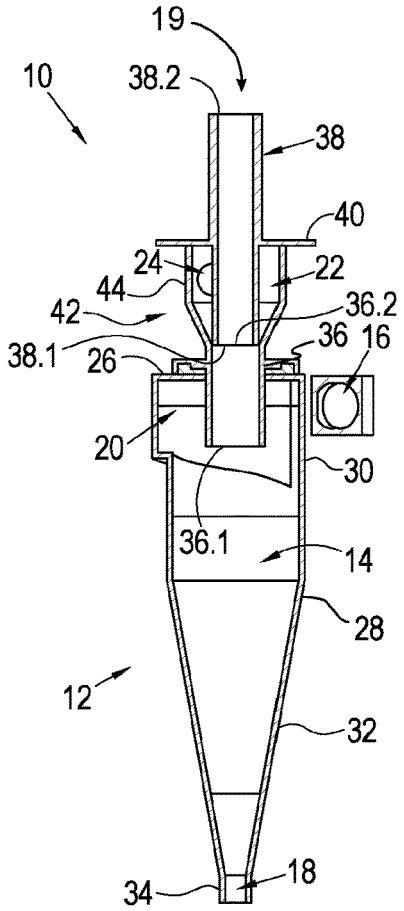
FIG. 4 is a simplified, longitudinal sectional view of the cyclonic separator of FIG. 1 with the vortex finder in a closed position.
Figure 5:
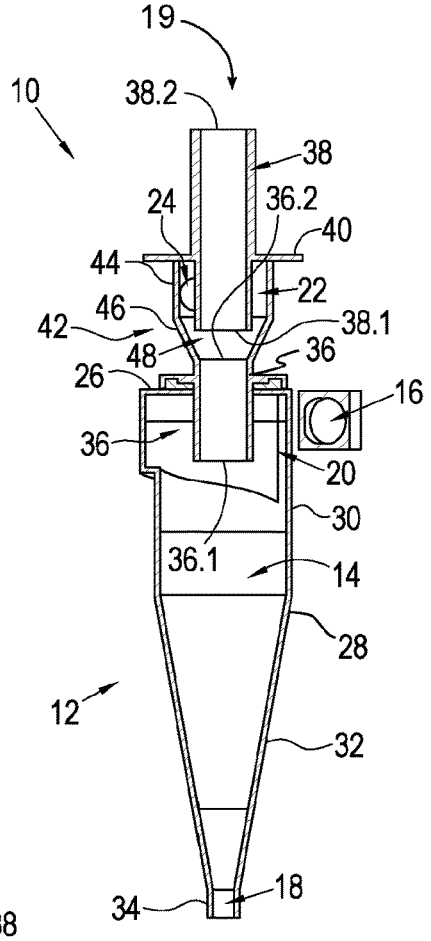
FIG. 5 is a simplified, longitudinal sectional view similar to FIG. 4 with the vortex finder in an intermediate position.
Figure 6:
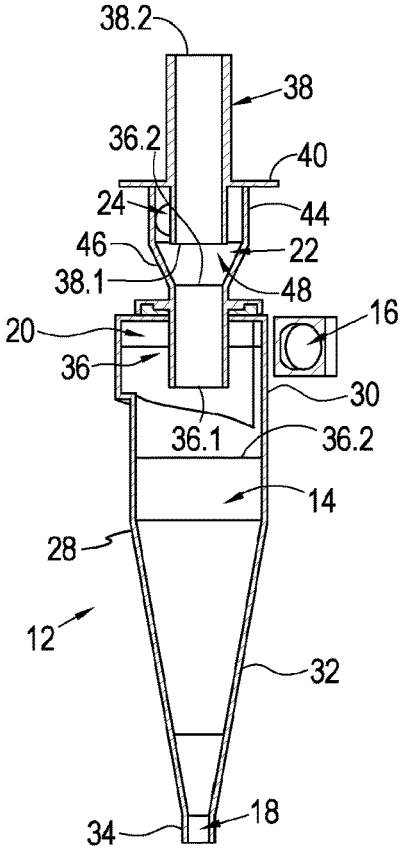
FIG. 6 is a simplified, longitudinal sectional view similar to FIG. 4 with the vortex finder in a fully open position.

As can best be seen in FIGS. 4 to 6, the vortex finder 20 includes a tubular cylindrical upstream portion 36 and a tubular cylindrical downstream portion 38. The upstream portion 36 has an upstream end 36.1 and a downstream end 36.2. Similarly, the downstream portion 38 has an upstream end 38.1 and a downstream end 38.2.

In the embodiment shown, the upstream portion 36 and downstream portion 38 are axially aligned and are of the same diameter. In other embodiments, the upstream portion 36 and the downstream portion 38 may have different diameters to each other, and each portion 36, 38 may not have a uniform diameter.

The intermediate chamber 22 is defined by a circular top 40 and a sidewall 42 which depends therefrom. The sidewall 42 has an upper portion 44 which is cylindrical and an upper end of which is closed by the top 40 and a frusto-conical lower portion 46 which protrudes from the upper portion 44 and tapers away from the top 40 (i.e. it narrows as it extends away from the top 40). The secondary overflow 24 leads from the intermediate chamber 22 through an opening in the sidewall 42. The downstream end 36.2 of the upstream portion 36 of the vortex finder 20 is attached to the lower or free edge of the lower portion 46 such that it protrudes therefrom through the top 26 into the separation chamber 14. The downstream portion 38 of the vortex finder 20 extends through the top 40 such that the upstream end 38.1 of the downstream portion 38 is positioned within the intermediate chamber 22 and the downstream end 38.2 of the downstream portion 38 forms the overflow discharge 19.

The position of the downstream portion 38 of the vortex finder 20 is axially adjustable between a fully closed position, shown in FIG. 4 of the drawings, and a fully open position shown in FIG. 6 of the drawings. In the fully closed position the upstream end 38.1 of the downstream portion 38 is closely spaced with or in abutment with the downstream end 36.2 of the upstream portion 36. In the fully open position the adjacent ends of the upstream portion and downstream portion 36, 38 are spaced apart to define between them a bleed opening 48 which opens into the intermediate chamber 22. The downstream portion 38 can be adjusted to any position between its closed and fully open positions such as an intermediate position illustrated in FIG. 5 of the drawings, thereby to adjust the size of the bleed opening 48.

In use, particulate containing fluid is fed through the feed inlet 16 into the separation chamber 14. By virtue of the configuration of the separation chamber 14, particles contained within the fluid are separated with the larger, heavier, more dense particles being discharged through the underflow discharge 18. An overflow stream containing the lighter particles passes upwardly through the vortex finder 20. When the vortex finder 20 is in its fully closed position (shown in FIG. 4 of the drawings) the separator 10 functions as a conventional separator and all of the inner vortex or overflow stream and the particles contained therein pass through the vortex finder 20 and are discharged from the overflow discharge 19 defined by the downstream end 38.2 of the downstream portion 38. However, when adjacent ends of the upstream portion 36 and downstream portion 38 of the vortex finder 20 are spaced apart (i.e. when the bleed opening 48 is present), a portion of the overflow stream flowing through the vortex finder 20 is bled (or diverted)

from the vortex finder 20 through the opening 48 into the intermediate chamber 22 and discharged through the secondary overflow 24.

It will be appreciated that the inner vortex or overflow stream passing through the vortex finder 20 is moving upwards in a spiral and accordingly any oversized particles contained within the overflow stream tend to move radially outwardly and accordingly are fed through the bleed opening 48 into the intermediate chamber 22 and through the secondary overflow 24. By adjusting the spacing between the adjacent ends of the upstream portion 36 and downstream portion 38 of the vortex finder 20 and hence the effective size of the bleed opening 48, the volume of the overflow stream which is bled through the bleed opening 48 can be adjusted to optimise the removal of oversized particles.

The Inventors believe that this will reduce or eliminate the number of oversized particles contained within the fine fraction of overflow stream exiting through the overflow discharge 19 thereby reducing the requirement for further processing downstream of the separator 10. This has substantial cost and efficiency benefits.

Figure 7:
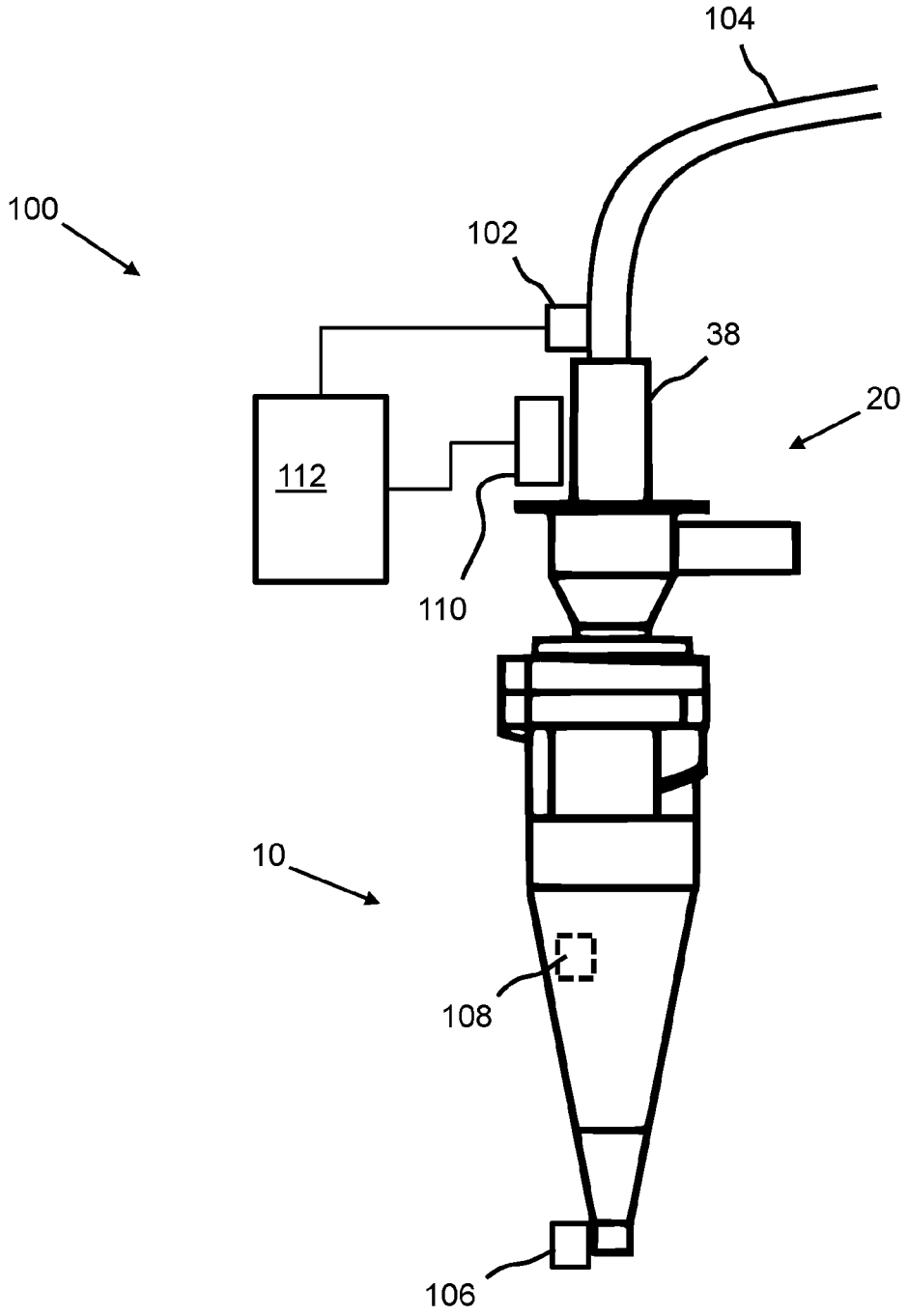
FIG. 7 is a simplified schematic drawing of an automatic cyclone control system including the cyclonic separator of FIG. 1.

Reference will now be made to FIG. 7, which is a simplified schematic drawing of an automatic cyclone control system 100 including the cyclonic separator 10.

The control system 100 comprises a first sensor 102 (an accelerometer) located at the overflow discharge 19 and mounted on an overflow pipe 104 coupled to the downstream portion 38 of the vortex finder 20; a second sensor 106 (another accelerometer) located at the spigot 34 and mounted on an external surface thereof, and a third sensor 108 (an accelerometer) mounted on an inside of the cyclone body 12. The accelerometers 102, 106, 108 are provided to assist in ascertaining the particle size at the location of those sensors 102, 106, 108.

An actuator 110 is mounted to the vortex finder 20 and is operable to control opening and closing of the bleed opening, in this embodiment by moving the downstream portion 38 axially up (to create or increase the size of the bleed opening) or down (to close or reduce the size of the bleed opening). In this embodiment, the actuator 110 comprises an electrically operated motor coupled to a worm gear enmeshed with a toothed rack. The rack is coupled to the downstream portion 38. When the motor rotates the worm gear (a pinion) it raises (when rotated in one direction) or lowers (when rotated in the opposite direction) the downstream portion 38.

A controller 112 is provided that is in electronic communication with the sensors 102, 106, 108 and the actuator 110 operable to control the actuator 110 in response to a measurement recorded by the at least one sensor 102, 106, 108. For example, if the sensor 102 detects that there is a greater than desired percentage of particles above a preset size, then the controller 112 may issue a command to the actuator 110 to open or increase the size of the bleed opening.

It should now be appreciated that particles larger than desired may be selectively removed from the vortex finder so that they are diverted away from the primary overflow. Such diverted particles may be recycled into the comminution process for further size reduction.

Figure 8:
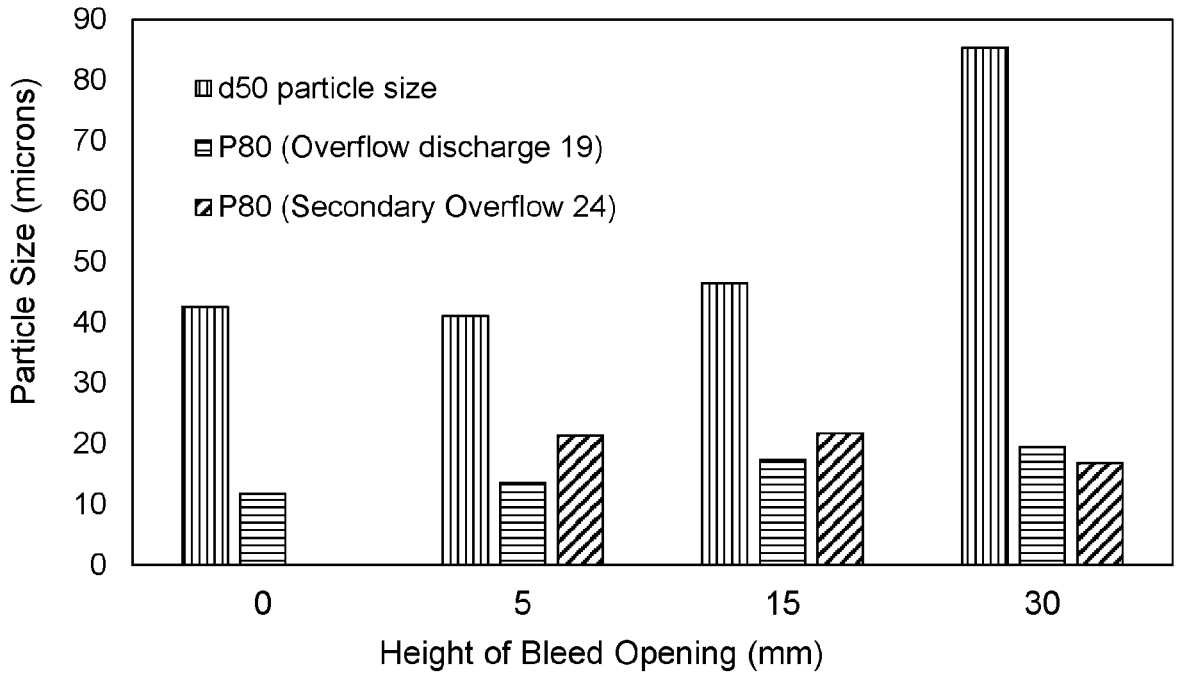
FIG. 8 is a graph showing the d50 and P80 particle sizes for four different positions of the vortex finder of the cyclonic separator of FIG. 1.
Figure 9:
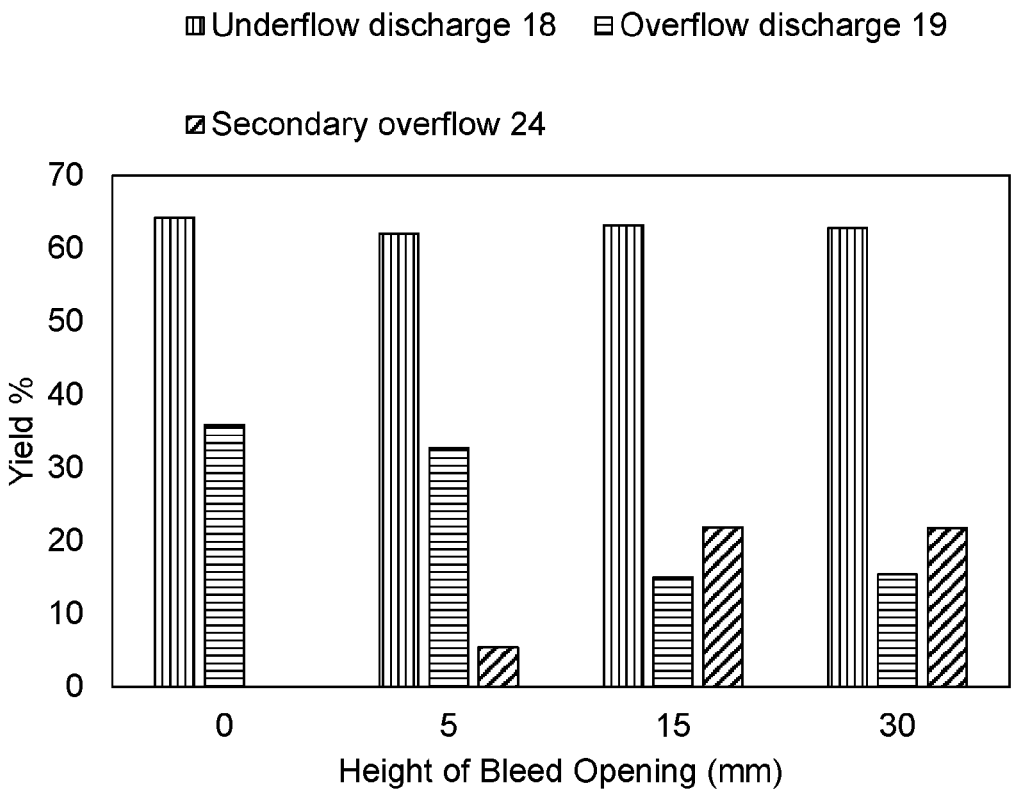
FIG. 9 is a graph showing the yield percentage at three different parts of the cyclonic separator of FIG. 1 for four different positions of the vortex finder.

Reference is now made to FIGS. 8 and 9, which are graphs showing various parameters recorded from experiments relating to the performance of the hydrocyclone 10.

In the experiments a vortex diameter of 48 mm was used, and a spigot diameter of 18 mm. The vortex diameter is the diameter of the upstream portion 36 and also the downstream portion 38 (they both have the same diameters in this embodiment). The inlet pressure to the hydrocyclone 10 was 15 psi (approximately 103 kPa) and the solids concentration of the slurry was 15% by weight.

FIG. 8 shows the d50 and P80 particle sizes for four different gaps between the upstream and downstream portions 36, 38. The d50 particle size is the size at which 50% of the particles are smaller than this size and 50% of the particles are larger than this size; in other words the median particle size. The P80 size is the smallest particle size that is larger than 80% of the particles.

As can be seen from FIG. 8, with no gap between the upstream and downstream portions 36, 38 (i.e. no bleed opening 48), the d50 particle size is approximately 42 microns, the P80 particle size at the overflow discharge 19 is approximately 12 microns, and there is no discharge from the secondary overflow 24 (since there is no bleed opening 48).

When the bleed opening 48 is 5 mm (i.e. the gap between the downstream end 36.2 of the upstream portion 36, and the upstream end 38.1 of the downstream portion 38), the d50 particle size is similar to when there was no gap (approximately 41 microns), the P80 particle size at the overflow discharge 19 is also similar (approximately 11 microns), but the P80 particle size from the secondary overflow 24 is approximately 21 microns. Thus, the secondary overflow 24 removes a higher percentage of large particles than the overflow discharge 19.

When the bleed opening 48 is 15 mm, the d50 particle size is slightly higher at approximately 47 microns), the P80 particle size at the overflow discharge 19 is also higher (approximately 17 microns), but the P80 particle size from the secondary overflow 24 is only slightly higher (approximately 22 microns).

Increasing the bleed opening 48 to 30 mm results in a significant rise in the d50 particle size (85 microns), the P80 particle size at the overflow discharge 19 is slightly higher (approximately 19 microns), but the P80 particle size from the secondary overflow 24 is lower (approximately 17 microns).

FIG. 9 is a graph showing the yield percentage at the underflow discharge 18, the overflow discharge 19, and the secondary overflow 24 for the four different sizes of bleed opening 48. The experimental parameters were the same as for the results shown in FIG. 8. The yield percentage is the mass of solids at each discharge point as a percentage of the total mass discharged.

As can be seen in FIG. 9, the percentage of mass at the underflow discharge 18 is generally the same regardless of the size of the bleed opening 48 (approximately 63%). With no gap, the remaining amount (approximately 37%) reports via the overflow discharge 19. As the gap is opened to 5 mm, a small amount (approximately 5%) reports via the secondary overflow 24, with the remainder (approximately 32%) reporting via the overflow discharge 19. When the bleed opening 48 gap is increased to 15 mm or 30 mm, a higher percentage (approximately 22%) reports via the secondary overflow 24 than via the overflow discharge 19 (approximately 15%).

It will now be apparent that the size of bleed opening 48 can be selected depending on the relative particle sizes desired at the overflow discharge 19 and the secondary overflow 24. For example, the coarser flow from the secondary overflow 24 may be transported directly to a regrinding process to reduce the particle size. In another application (such as dewatering), the coarser flow from the secondary overflow 24 may be transported to a thickener to aid sedimentation and thereby use less chemicals. The finer flow from the overflow discharge 19 may be transported directly to a flotation cell without requiring any screening or return to the regrinding process.

Various modifications may be made to the above described embodiments within the scope of the present invention. For example, the actuator may comprise a belt arrangement. The bleed opening 48 may be formed by rotating the inlet or outlet ends, or by enlarging portions (or all) of the inlet and outlet ends.

REFERENCE NUMERALS cyclonic separator (hydrocyclone) 10
cyclone body 12
separation chamber 14
feed inlet 16
underflow discharge 18
overflow discharge 19
vortex finder 20
(vortex finder) intermediate chamber 22
(vortex finder) secondary overflow 24.
circular top 26
sidewall 28
cylindrical upper portion 30
frusto-conical lower portion 32
spigot 34
(vortex finder) tubular cylindrical upstream portion 36
upstream end 36.1
downstream end 36.2
(vortex finder) tubular cylindrical downstream portion 38
upstream end 38.1
downstream end 38.2.
(intermediate chamber) circular top 40
(intermediate chamber) sidewall 42
sidewall upper portion 44
frusto-conical lower portion 46
bleed opening 48
automatic cyclone control system 100
first sensor 102
overflow pipe 104
second sensor 106
third sensor 108
actuator 110
controller 112

The invention claimed is:

1. A cyclonic separator comprising:

a body having a top and a sidewall defining a separation chamber, the sidewall having a generally cylindrical upper portion and a frusto-conical lower portion tapering away from the upper portion, a feed inlet leading into the separation chamber, an underflow discharge leading from the separation chamber and defined by a spigot attached to a lower end of the lower portion of the sidewall, and a vortex finder, the vortex finder comprising:

an intermediate chamber, an axially arranged upstream portion positioned in the separation chamber, an axially arranged downstream portion defining an overflow discharge, a secondary overflow discharge leading from the intermediate chamber, and a bleed opening defined between the upstream and downstream portions and leading into the intermediate chamber, and through which a portion of an overflow stream can be bled from the secondary overflow discharge to remove oversized particles from the overflow stream, wherein the upstream and downstream portions of the vortex finder are co-axial and at least one of the portions is axially displaceable relative to the other to permit the spacing between adjacent ends of the upstream and downstream portions of the vortex finder, and hence the size of the bleed opening, to be adjustable, so that the size of bleed opening can be selected depending on the relative particle sizes desired at the overflow discharge and the secondary overflow, and wherein the intermediate chamber is defined by a circular top and a sidewall depending therefrom, the sidewall having a cylindrical upper portion, an upper end of which is closed by the top and a frusto-conical lower portion protruding from the upper portion and tapering away from the top.

2. The separator as claimed in claim claim 1, in which the feed inlet is configured to feed fluid into the separation chamber at or close to the top thereof, generally tangentially, to create a swirling flow of the fluid in the separation chamber.

3. The separator as claimed in claim 2, in which the upstream portion of the vortex finder includes an upstream end which is positioned in the separation chamber and forms the inlet end of the vortex finder and a downstream end, the downstream portion of the vortex finder having an upstream end and a downstream end which forms the overflow discharge, the bleed opening being defined between the downstream end of the upstream portion of the vortex finder and the upstream end of the downstream portion of the vortex finder.

4. The separator as claimed in claim 2, in which the upstream and downstream portions of the vortex finder are of the same diameter.

5. The separator as claimed in claim 4, in which the upstream and downstream portions of the vortex finder are displaceable between a closed position in which the bleed opening is closed and a fully opened position in which the bleed opening is at its maximum size.

6. The separator as claimed in claim 1, in which a free or lower end of the frusto-conical lower portion is connected to the downstream end of the upstream portion of the vortex finder.

7. An automatic cyclone control system comprising a separator according to claim 1; at least one sensor operable to measure a characteristic of an underflow or overflow discharge of the separator; an actuator operable to control opening and closing of the bleed opening in the vortex finder of the separator; and a controller operable to control the actuator in response to a measurement recorded by the at least one sensor.

8. The automatic cyclone control system according to claim 7, wherein the actuator comprises an electric or hydraulic solenoid.

9. A method of operating a cyclonic separator which includes a separation chamber, a feed inlet leading into the separation chamber, an underflow discharge leading from the separation chamber and a vortex finder which has an axially arranged upstream portion positioned in the separation chamber and an axially arranged downstream portion defining an overflow discharge, the upstream and downstream portions defining a bleed opening therebetween and leading into an intermediate chamber defined by a circular top and a sidewall depending therefrom, the sidewall having a cylindrical upper portion, an upper end of which is closed by the top and a frusto-conical lower portion protruding from the upper portion and tapering away from the top, which method includes bleeding a portion of an overflow stream passing through the vortex finder from the vortex finder at a position between the upstream and downstream portions of the vortex finder to remove oversized particles from the overflow stream, and using an actuator to control opening and closing of the bleed opening to adjust the size of the bleed opening depending on the relative particle sizes desired at the overflow discharge and the secondary overflow.

10. The method as claimed in claim 9, which includes feeding the portion of the overflow stream which is bled from the vortex finder into an intermediate chamber from which an intermediate discharge opening leads.

11. A vortex finder comprising:

(i) an axially arranged upstream portion for locating in a separation chamber of a cyclone, (ii) an axially arranged downstream portion defining an overflow discharge, (iii) an intermediate chamber;

(iv) a secondary overflow discharge leading from the intermediate chamber; and (v) a bleed opening at a position between the axially arranged upstream and downstream portions of the vortex finder through which a portion of an overflow stream can be bled from the vortex finder through the secondary overflow discharge to remove oversized particles from the overflow stream;

wherein at least one of the axially arranged upstream and downstream portions of the vortex finder is axially displaceable relative to the other to permit the spacing between adjacent ends of the axially arranged upstream and downstream portions of the vortex finder, and hence the size of the bleed opening, to be adjustable so that the size of bleed opening can be selected depending on the relative particle sizes desired at the overflow discharge and the secondary overflow, and wherein the intermediate chamber is defined by a circular top and a sidewall depending therefrom, the sidewall having a cylindrical upper portion, an upper end of which is closed by the top and a frusto-conical lower portion protruding from the upper portion and tapering away from the top.

* * * * *